US007692143B2

(12) United States Patent
Guna

(10) Patent No.: US 7,692,143 B2
(45) Date of Patent: Apr. 6, 2010

(54) METHOD FOR AXIAL EJECTION AND IN-TRAP FRAGMENTATION USING AUXILIARY ELECTRODES IN A MULTIPOLE MASS SPECTROMETER

(75) Inventor: Mircea Guna, Toronto (CA)

(73) Assignees: MDS Analytical Technologies, a business unit of MDS Inc., Concord, Ontario (CA); Applied Biosystems (Canada) Limited, Toronto, Ontario (CA)

( * ) Notice: Subject to any disclaimer, the term of this patent is extended or adjusted under 35 U.S.C. 154(b) by 168 days.

(21) Appl. No.: 11/839,081

(22) Filed: Aug. 15, 2007

(65) Prior Publication Data

US 2008/0078927 A1 Apr. 3, 2008

Related U.S. Application Data

(60) Provisional application No. 60/827,234, filed on Sep. 28, 2006.

(51) Int. Cl.
*H01J 49/26* (2006.01)

(52) U.S. Cl. ..... 250/292

(58) Field of Classification Search ..... 250/290, 250/292, 281, 282

See application file for complete search history.

(56) References Cited

U.S. PATENT DOCUMENTS

| | | | | |
|---|---|---|---|---|
| 6,111,250 | A | 8/2000 | Thomson et al. | |
| 6,177,668 | B1 | 1/2001 | Hager | |
| 6,403,953 | B2 | 6/2002 | Whitehouse et al. | |
| 6,403,955 | B1 | 6/2002 | Senko | |
| 6,504,148 | B1 | 1/2003 | Hager | |
| 6,507,019 | B2 | 1/2003 | Chernushevich et al. | |
| 6,627,912 | B2 | 9/2003 | Bandura et al. | |
| 6,703,607 | B2 | 3/2004 | Stott et al. | |
| 6,909,089 | B2 | 6/2005 | Londry et al. | |
| 7,495,213 | B2 * | 2/2009 | Loboda | 250/292 |
| 2003/0189168 | A1 | 10/2003 | Londry et al. | |
| 2003/0189171 | A1 | 10/2003 | Londry et al. | |
| 2007/0084998 | A1 * | 4/2007 | Franzen et al. | 250/287 |
| 2008/0191130 | A1 * | 8/2008 | Bateman et al. | 250/283 |

OTHER PUBLICATIONS

International Search Report, International Application No. PCT/CA2007/001360; Mailing date: Nov. 22, 2008.

Igor V. Chernushevich, Duty Cycle Improvement for a Quadrupole-Time-of-Flight Mass Spectrometer and Its Use for Precursor Ion Scans, IM Publications 2000, ISSN 1469-0667.

(Continued)

*Primary Examiner*—Kiet T Nguyen

(74) *Attorney, Agent, or Firm*—Bereskin & Parr LLP/S.E.N.C.R.L., s.r.l.

(57) ABSTRACT

A method of operating a mass spectrometer having an elongated rod set and a set of auxiliary electrodes is provided, the rod set having an entrance end and an exit end and a longitudinal axis. The method comprises a) admitting ions into the entrance end of the rod set; b) trapping at least some of the ions in the rod set by producing a barrier field at an exit member adjacent to the exit end of the rod set and by producing an RF field between the rods of the rod set; and, c) providing an auxiliary AC excitement voltage to the set of auxiliary electrodes to energize a first group of ions of a selected mass to charge.

13 Claims, 20 Drawing Sheets

OTHER PUBLICATIONS

B.A. Collings, Increased Fragmentation Efficiency of Ions in a Low Pressure Linear Ion trap With an Added dc Octopole Field, American Society for Mass Spectrometry, 2005, Elsevier Inc., USA.

James W. Hager, "A New Linear Ion Trap Mass Spectrometer", Rapid Communications of Mass Spectrometry, 2002, p. 512-526, vol. 16, John Wiley & Sones, Ltd. USA.

Communication Pursuant to Rules 161 and 162 EPC, Application No. 07785024.6 - 1232, dated May 29, 2009.

M. Judith Charles, Scott a. Mcluckey, Gary L. Glish, "Competition between Resonance Ejection and Ion Dissociation during Resonant Excitation in a Quadrupole Ion Trap", Am. Soc. Mass Spectrom. 1994, 5, 1031-1041;.

James Hager, J.C. Yves Le Blanc, "Product Ion Scanning Using a Q-q-Qlinear Ion Trap (Q TrapTM) Mass Spectrometer", Rapid Communications in Mass Spectrometry, 2003, 17, 1056-1064;.

* cited by examiner

METHOD FOR AXIAL EJECTION AND IN-TRAP FRAGMENTATION USING AUXILIARY ELECTRODES IN A MULTIPOLE MASS SPECTROMETER

RELATED APPLICATIONS

The application claims the benefit of U.S. Provisional Application Ser. No. 60/827,234, filed Sep. 28, 2006, the entire contents of which is hereby incorporated by reference.

FIELD

The present invention relates generally to mass spectrometry, and more particularly relates to a method of operating a mass spectrometer having auxiliary electrodes.

INTRODUCTION

Typically, linear ion traps store ions using a combination of a radial RF field applied to the rods of an elongated rod set, and axial direct current (DC) fields applied to the entrance end and the exit end of the rod set. As described in U.S. Pat. No. 6,177,668, ions trapped within the linear ion trap can be scanned mass dependently axially out of the rod set and past the DC field applied to the exit lens. Further, as described in US Patent Publication No. 2003/0189171, ions trapped in a linear quadrupole low-pressure ion trap can be fragmented by resonant excitation.

SUMMARY

In accordance with an aspect of an embodiment of the invention, there is provided a method of operating a mass spectrometer having an elongated rod set and a set of auxiliary electrodes, the rod set having an entrance end and an exit end and a longitudinal axis. The method comprises a) admitting ions into the entrance end of the rod set; b) trapping at least some of the ions in the rod set by producing a barrier field at an exit member adjacent to the exit end of the rod set and by producing an RF field between the rods of the rod set, wherein the RF field and the barrier field interact in an extraction region adjacent the exit end of the rod set to produce a fringing field; and, c) providing an auxiliary ejection-inducing AC excitement voltage to the set of auxiliary electrodes to energize a first group of ions of a selected mass to charge ratio within the extraction region to mass selectively axially eject the first group of ions from the rod set past the barrier field.

In accordance with a further aspect of an embodiment of the invention, there is provided a method of operating a mass spectrometer having an elongated rod set and a set of auxiliary electrodes, the rod set having an entrance end and an exit end and a longitudinal axis. The method comprises a) admitting ions into the entrance end of the rod set; b) trapping at least some of the ions in the rod set by producing a barrier field at an exit member adjacent to the exit end of the rod set and by producing an RF field between the rods of the rod set, wherein the RF field and the barrier field interact in an extraction region adjacent the exit end of the rod set to produce a fringing field; c) providing an auxiliary fragmentation AC excitement voltage to the set of auxiliary electrodes to energize a parent group of ions; and, d) providing a background gas between the rods of the rod set to fragment the parent group of ions energized in step c).

These and other features of the Applicant's teachings are set forth herein.

BRIEF DESCRIPTION OF THE DRAWINGS

The skilled person in the art will understand that the drawings, described below, are for illustration purposes only. The drawings are not intended to limit the scope of the Applicant's teachings in any way.

DESCRIPTION

Figure 1A:
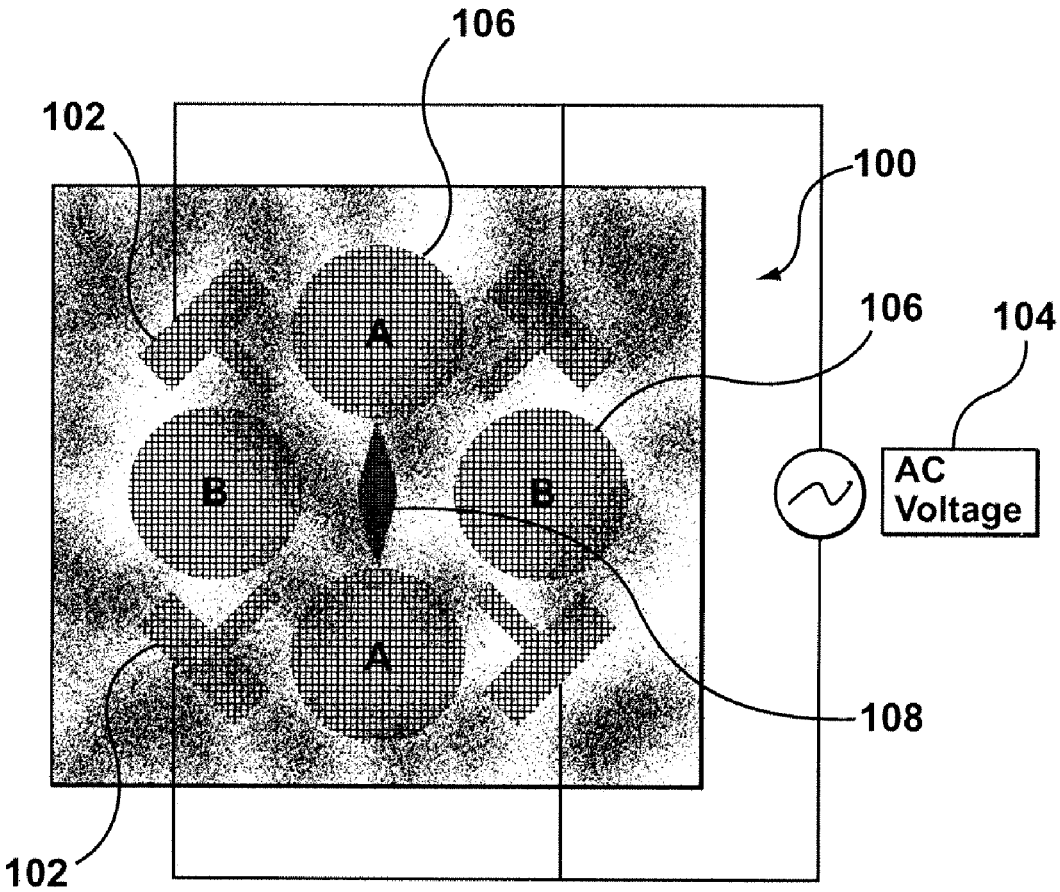
FIG. 1*a*, in a sectional view, illustrates an ion trap of a mass spectrometer system, which can be used to implement an aspect of an embodiment of the invention.

Referring to FIG. 1*a*, there is illustrated in a sectional view, a linear ion trap 100 incorporating auxiliary electrodes 102, which may be employed to implement a method in accordance with an aspect of an embodiment of the present invention. As shown, the linear ion trap 100 also comprises a rod set 106 having A-rods and B-rods, together with an AC voltage source 104 that would typically be connected to the A-rods to apply a dipolar auxiliary AC voltage to the A-rods to provide either mass selective axial ejection or in-trap fragmentation. By applying auxiliary AC voltages to the auxiliary electrodes situated between the rods, instead of applying an auxiliary AC voltage to the quadrupole rods themselves, analogous performance for both mass selective axial ejection or in-trap fragmentation can be obtained. That is, auxiliary AC voltage applied to the auxiliary electrodes can be used to (i) radially excite ions to mass selective axial eject the ions; and (ii) radially excite ions to fragment them through CAD/CID with a background gas. In addition, when the auxiliary electrodes are segmented, as will be described in more detail below, these segmented auxiliary electrodes can be used to spatially select and excite ions along a single linear multipole. That is, ions can be fragmented and/or extracted only from the particular sections of the multipole where particular auxiliary electrodes are present. By this means, tandem MS and MS/MS in time and space can be implemented using a single multipole rod set, in that in one section ions can be fragmented, while in another section ions are being ejected.

In the linear ion trap of FIG. 1*a*, the AC voltage source 104 is connected to all four auxiliary electrodes 102. AC voltage source 104 is not connected to either the A-rods or B-rods of the rod set 106, which are the positive and negative poles, respectively, of the quadrupole rod set. The black trace 108 inside the rod set 106 represents the ion trajectory simulated using simulation software. In the simulation conducted, the DC voltage applied to the auxiliary electrodes 102 was treated as the same as the DC voltage applied to the rods of the rod set 106.

Figure 1B:
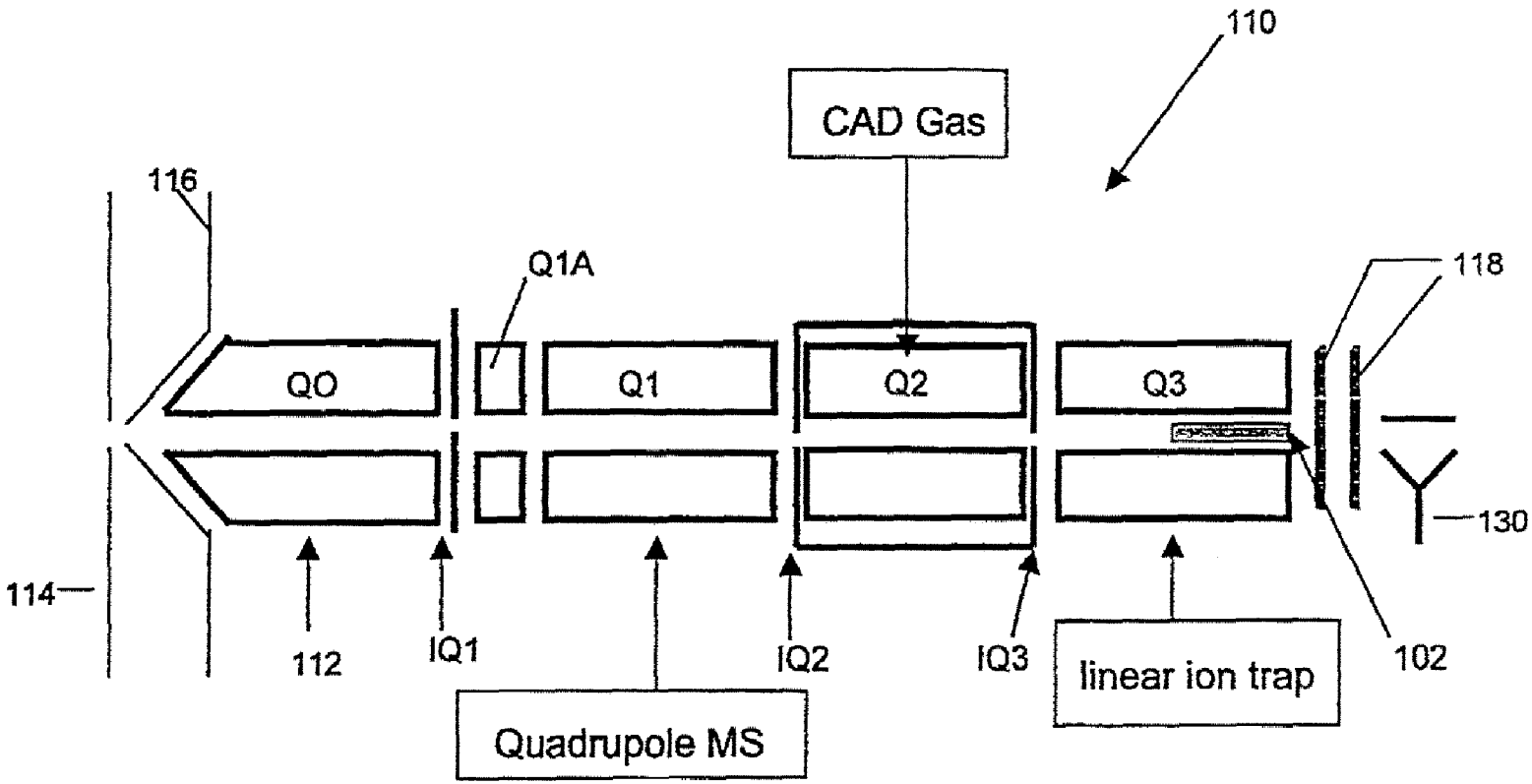
FIG. 1*b*, in a schematic diagram, illustrates an example of a mass spectrometer system incorporating the Q3 linear ion trap of FIG. 1*a*.

Referring to FIG. 1*b* there is illustrated in a schematic diagram, a variant of a Q-q-Q linear ion trap mass spectrometer system, as generally described in U.S. Pat. No. 6,504,148, and by Hager and LeBlanc in Rapid Communications of Mass Spectrometry, 2003, 17, 1056-1064. The linear ion trap mass spectrometer system of FIG. 1*b* has been modified slightly, however, in that the Q3 linear ion trap incorporates auxiliary electrodes 102 as shown in FIG. 1*a*.

During operation of the linear ion trap mass spectrometer system 110, ions are emitted into a vacuum chamber 112 through an orifice plate 114 and skimmer 116. Any ion source, such as, for example, MALDI or ESI can be used. The mass spectrometer system 110 comprises four elongated sets of rods Q0, Q1, Q2 and Q3, with orifice plates IQ1 after rod set Q0, IQ2 between Q1 and Q2, and IQ3 between Q2 and Q3. An additional set of stubby rods Q1A is provided between orifice plate IQ1 and elongated rod set Q1.

In some cases, fringing fields between neighbouring pairs of rod sets may distort the flow of ions. Stubby rods Q1A are provided between orifice plate IQ1 and elongated rod set Q1 to focus the flow of ions into the elongated rod set Q1.

Ions are collisionally cooled in Q0, which may be maintained at a pressure of approximately $8\times10^{-3}$ Torr. In FIG. 1*a*, Q1 operates as a quadrupole mass spectrometer, while Q3 operates as a linear ion trap. Of course, the configuration of Q1 and Q3 could easily be reversed. Q2 is a collision cell in which ions collide with a collision gas to be fragmented into products of a lesser mass. Optionally, stubby rods Q2A and Q3A may be provided upstream and downstream of Q2, respectively. In some cases, Q2 can be used as a reaction cell in which ion-neutral or ion-ion reactions occur to generate other types or adducts. In addition to being operable to trap a wide range of ions, Q3 can be operated as a linear ion trap with mass selective axial ejection or mass selective fragmentation using auxiliary excitement voltages applied to auxiliary electrodes 102.

Typically, ions can be trapped in the linear ion trap Q3 using radial RF voltages applied to the quadrupole rods, and DC voltages applied to the end aperture lenses. DC voltage differences between the end aperture lenses and the rod set can be used to provide the barrier fields. Of course, no actual voltage need be provided to the end lenses themselves, provided an offset voltage is applied to provide the DC voltage difference. Alternatively a time-varying barrier, such as an AC or RF field, may be provided at the end aperture lenses. In cases where DC voltages are used at each end of linear ion trap Q3 to trap the ions, the voltage differences provided at each end may be the same or may be different.

Figure 2A:
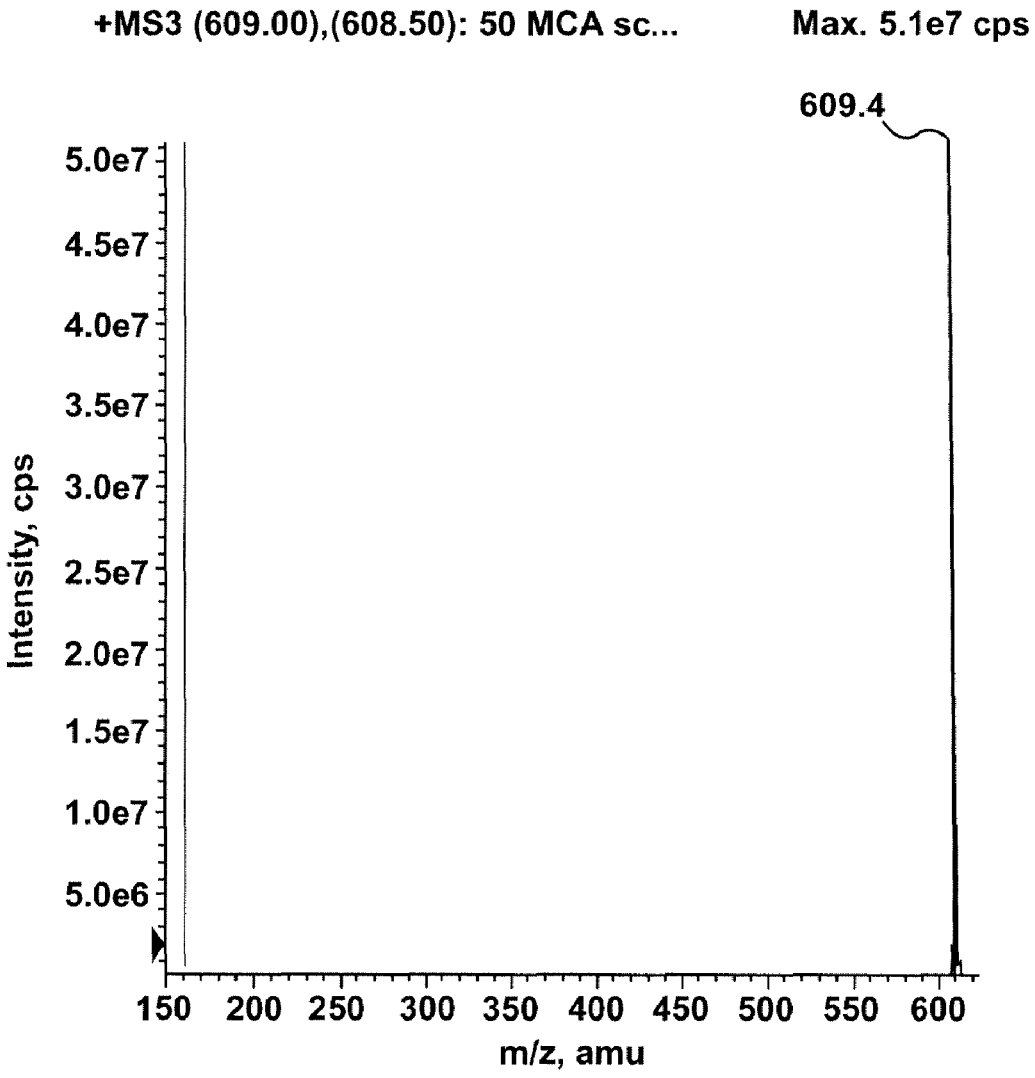
FIG. 2*a*, in a graph, illustrates the ion trap spectra of the 609 Da/s reserpine ion obtained at 1000 Da/s, and axially scanned out of the linear ion trap of FIG. 1*a* using excitation on the auxiliary electrodes.
Figure 2B:
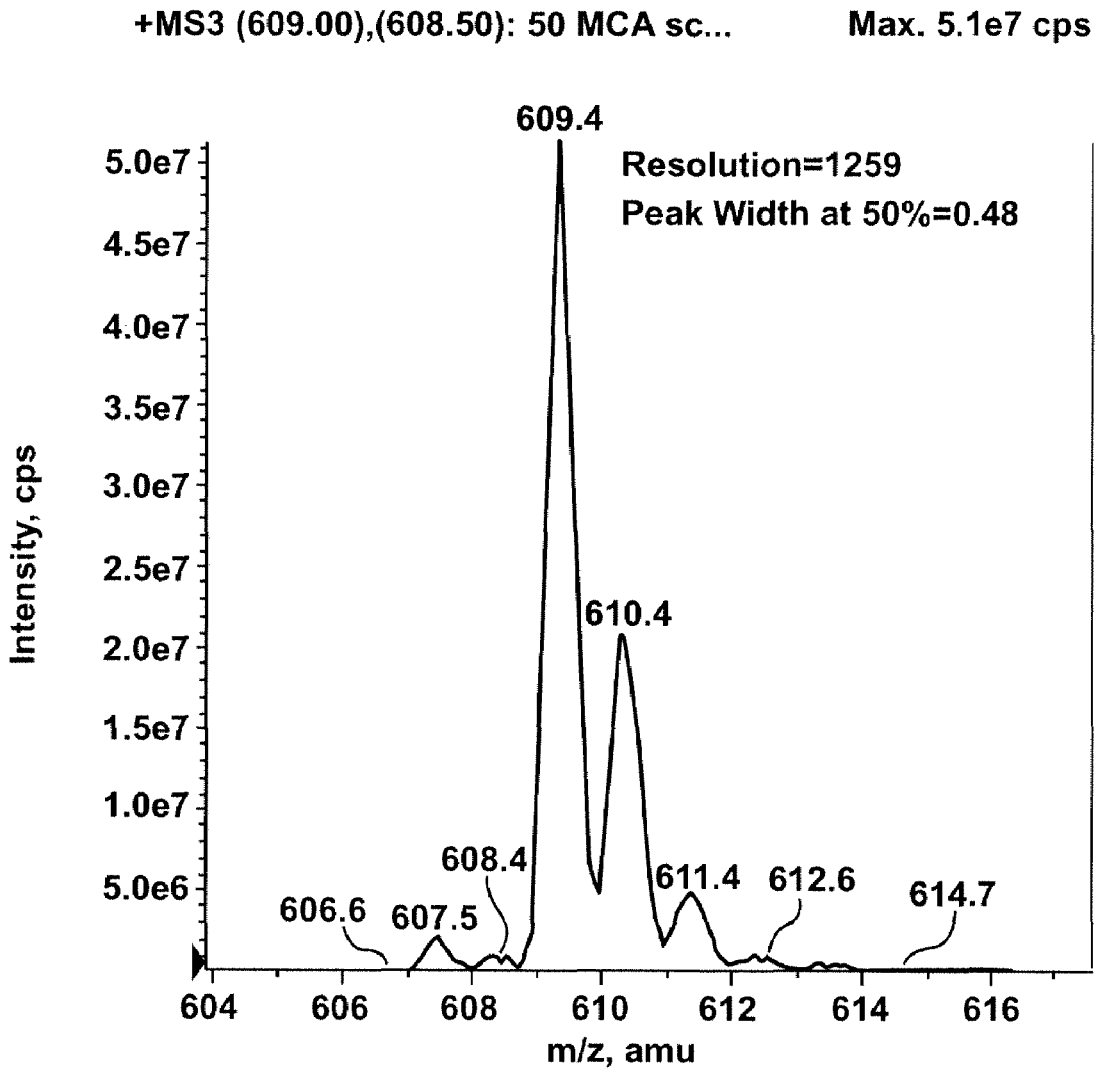
FIG. 2*b*, in a graph, illustrates the same ion trap spectra zoomed around the 609 Da peak.

Referring to FIG. 2*a*, an ion trap spectra of the 609 Da/s reserpine ion obtained at 1000 Da/s are shown. The ion is selected in the filtering quadrupole Q1 at open resolution, transmitted through the Q2 collision cell at low collision energy (CE=10 eV) into the Q3 trap. Stubby rods Q2A and Q3A, as described above, were provided at each end of Q2 to obtain these results. Within the Q3 trap, the ion is DC/RF isolated and then cooled and scanned out of the trap using excitation voltages applied to the auxiliary electrodes. The excitation voltage applied to the auxiliary electrodes was 30Vp-p. If the depth of the stem is increased, i.e. closer to the axis, the field created by the T-electrodes becomes stronger. As a result the voltage required to be applied to electrodes for axial ejection to occur is lower. Referring to FIG. 2*b*, the same ion trap spectra is shown zoomed around the 609 Da peak.

Figure 3A:
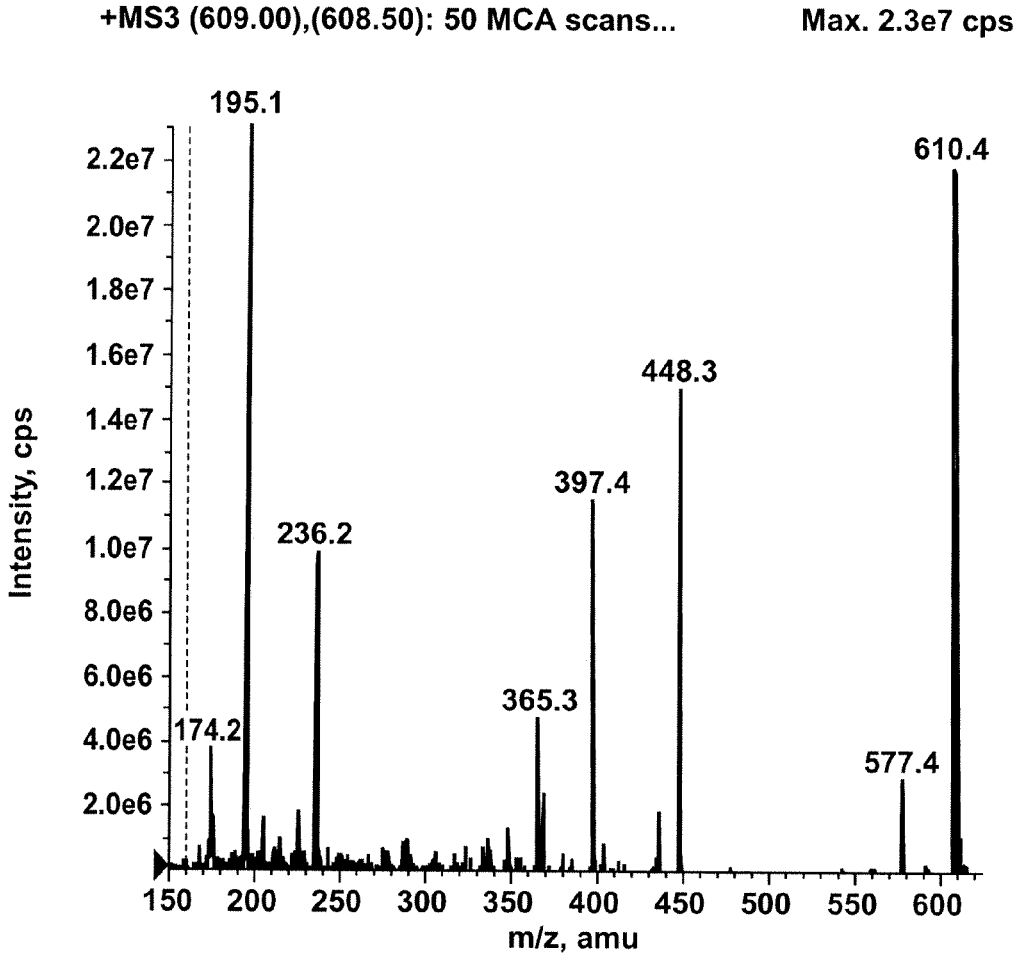
FIG. 3*a*, in a graph, shows the in-trap MS/MS spectra of the 609 Da/s reserpine ion obtained at 1000 Da/s after fragmentation in the linear ion trap of FIG. 1*a* using AC voltage excitation applied via the auxiliary electrodes.

Referring to FIG. 3*a*, an in-trap MS/MS spectra of the 609 Da/s reserpine ion obtained at 1000 Da/s are shown. In this case, the parent ion, 609.3 Da, is selected in the filtering quad Q1 at open resolution, transmitted through the Q2 collision cell at low collision energy (CE=10 eV) into the Q3 trap. Within the Q3 trap, this parent ion is DC/RF isolated and then fragmented using AC voltage excitation applied to the auxiliary electrodes 102. The q value used is 0.2363 and the excitation frequency is 85 KHz. After a 30 msec excitation period; the fragment ions are cooled and, then, scanned out of the trap using AC voltage excitation on the auxiliary electrodes.

Figure 3B:
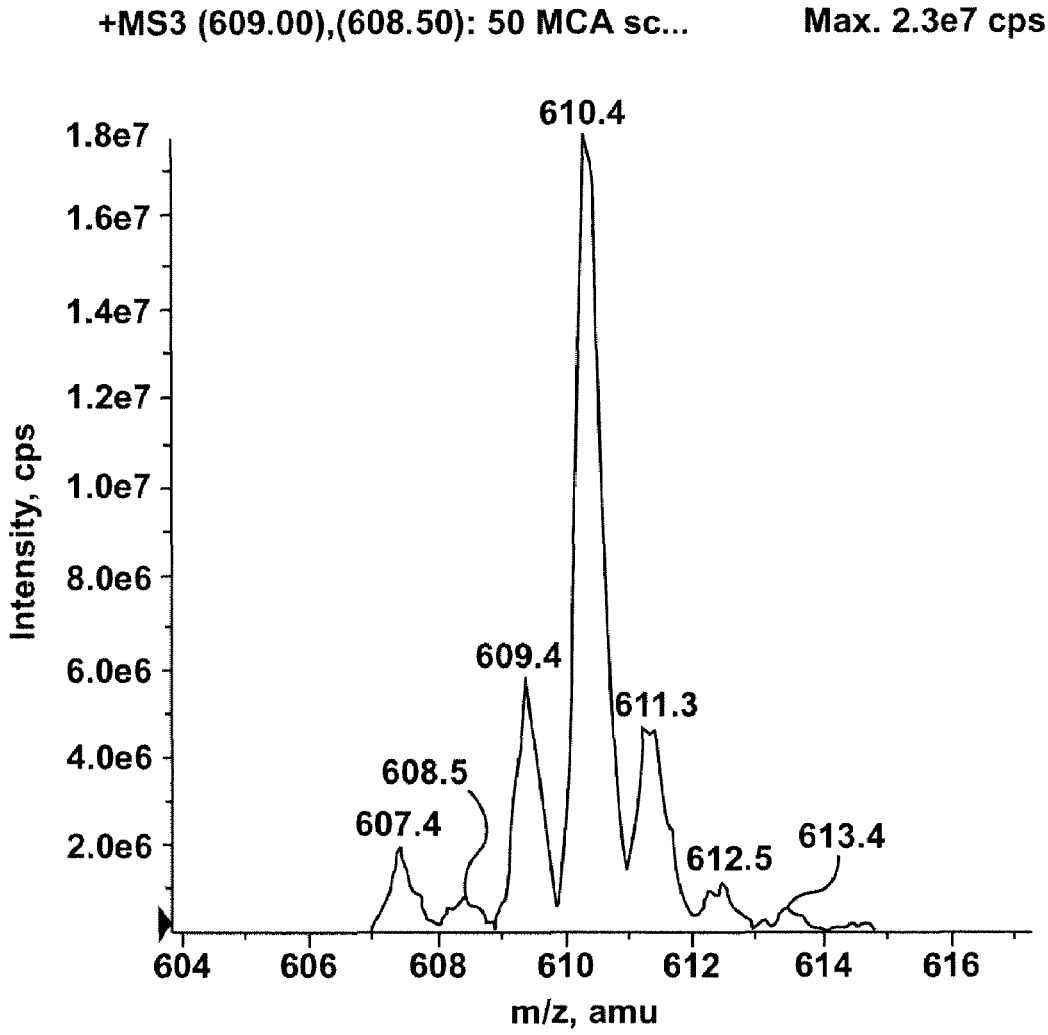
FIG. 3*b*, in a graph, illustrates the spectra of FIG. 3*a* zoomed in around the parent ion.

Referring to FIG. 3*b*, the spectra of FIG. 3*a* is again illustrated, zoomed around the parent ion. From the spectra it can be observed that while the intensity of the second isotope of the reserpine ion, 610.4 Da, as well as the intensity of the precursor peak 608.4 remains the same as the intensity observed in FIG. 2*b*, where no fragmentation took place, the intensity of the main isotope peak 609.3 Da drops to approximately 10% of the intensity observed in the no fragmentation case (FIGS. 2*a* and 2*b*). This data shows that the excitation process provides good mass resolution allowing excitation only of the 609.3 isotope ion.

Figure 4A:
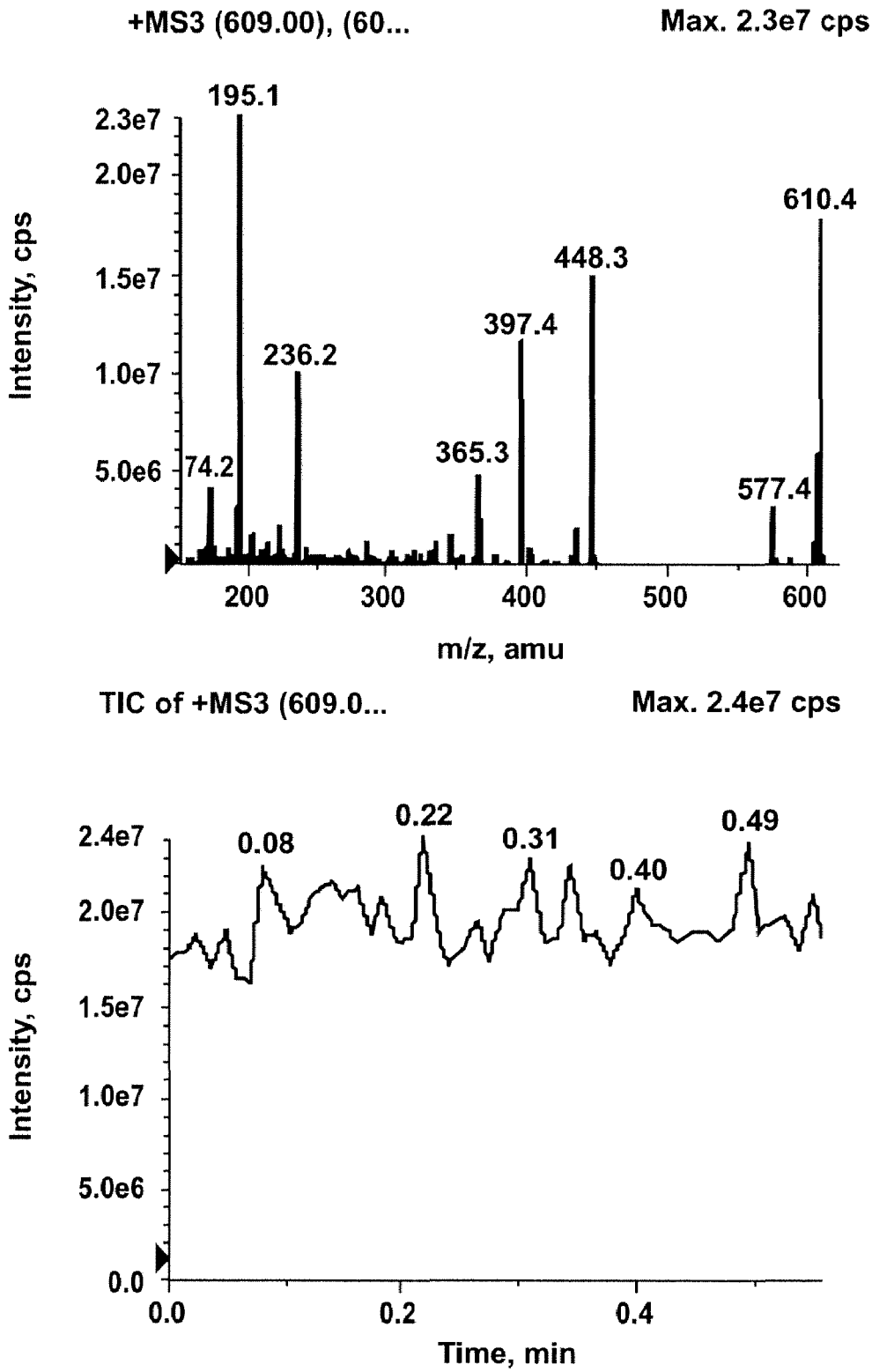
FIGS. 4*a* and 4*b*, in graphs, illustrate scaled versions of the spectra of FIGS. 3*a* and 2*a* respectively, as well as the total ion chromatogram for each spectra.
Figure 4B:
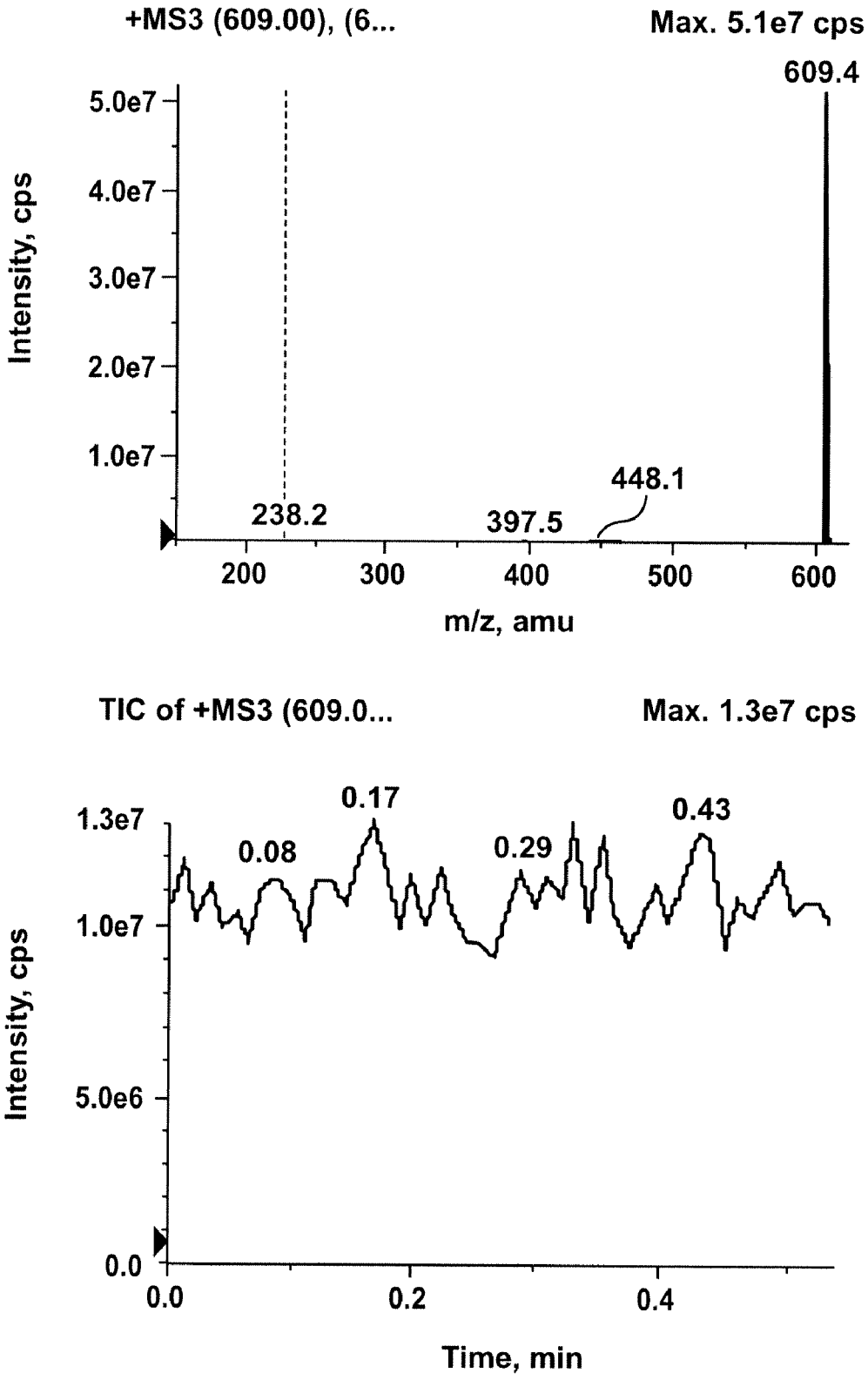

Referring to FIGS. 4*a* and 4*b*, scaled versions of the spectra of FIGS. 3*a* and 2*a* respectively are illustrated in graphs to show their corresponding total ion count (TIC). As shown in these figures, the fragmentation efficiency can be extremely high. The apparent efficiency may seem higher than 100% because the extraction efficiency varies with mass.

The appearance of an MS/MS spectrum, both in terms of product ion formation and ion abundance, is a function of the amount of kinetic energy of the ion that is converted into internal energy through collisions with the bath gas, the rate at which this conversion takes place, as well as the type of the chemical bond that is fragmented.

The power absorbed by an ion through resonance excitation is directly related to the amplitude of the resonance excitation voltage, the duration of the excitation and the power lost through collisions with the target gas. The maximum kinetic energy that an ion can have and remain trapped is determined by the depth of the effective potential, the RF potential barrier, which in turn increases with the square of the q-value. Therefore the higher the q-value at which the fragmentation occurs the higher the value of the average kinetic energy that the ion can gain between collisions and the shorter the fragmentation time required to activate a specific fragmentation channel.

In the case of the reserpine ion, mass 609 Da, the typical CAD/collision cell experiment is performed at collision energies of 40 to 50 eV. In my experiments the fragmentation time was 30 ms while the excitation voltage was 4Vp-p. For the harder to fragment ion 922 Da, from an Agilent solution, for which typical CAD/collision cell experiment is performed at collision energies of 80 to 90 eVp-p, the fragmentation time was 50 ms while the excitation voltage was 8Vp-p. In both cases the bath gas pressure was $3.3\times10^{-5}$ Torr. The q-value was 0.236. All experiments were performed using T-electrodes having the stem at 8 mm distance from the center axis of the quadrupole. If the depth of the stem is increased, i.e. closer to the axis, the field created by the T-electrodes becomes stronger. As a result the voltage required to be applied to electrodes for fragmentation to occur is lower.

In general, the fragmentation time and the amplitude of the resonance excitation voltage will vary depending on the particular compound as well as the pressure and value of q at which the activation/excitation takes place. There is extensive literature on in-trap fragmentation both at high pressures (mTorr), as well as at low pressures ($10^{-5}$ Torr). See, for example, M. J. Charles, S. A. McLuckey, G. L. Glish, J. Am. Soc. Mass Spectrom., 1031-1041 (5) 1994.

Figure 5:
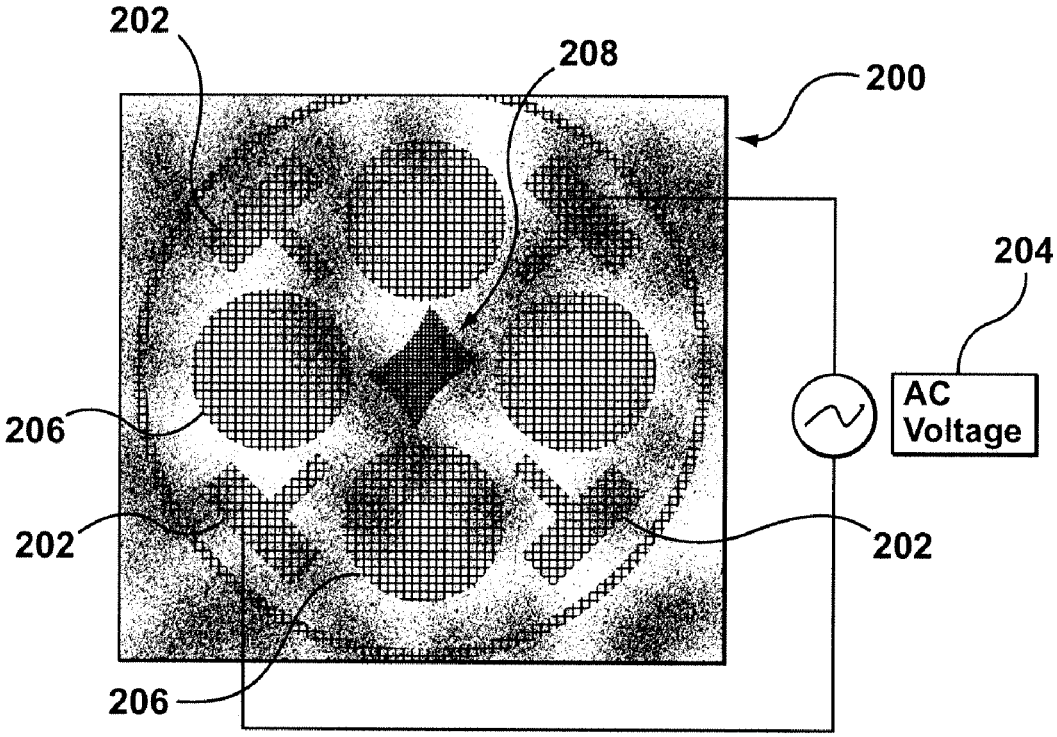
FIG. 5, in a sectional view, illustrates a further variant of a linear ion trap incorporating auxiliary electrodes using which methods in accordance with different aspects of an embodiment of the invention may be implemented.

Referring to FIG. 5, there is illustrated in a sectional view, a linear ion trap suitable for providing fragmentation and axial ejection methods in accordance with further aspects of an embodiment of the present invention. For clarity, the same reference numerals are used as were used to describe the linear ion guide 100 of FIG. 1*a*, except that 100 has been added. For brevity, some of the description of FIG. 1*a* is not repeated with respect to FIG. 5.

In the linear ion trap 200 of FIG. 5, AC voltage source 204 is connected to only two of the four auxiliary electrodes 202. Again, AC voltage source 204 is not connected to any of the rods of the rod set 206. The DC voltage applied to these two auxiliary electrodes 202 can be equal to the DC voltage applied to the rods 206. The black trace 208 inside the rod set 206 again represents the ion trajectory simulated using simulation software. Unlike the ion trajectory 108 of FIG. 1*a*, the ion trajectory 208 of FIG. 5 indicates that ion motion is excited along both of the quadrupole axes. In the experimental results described below with reference to linear ion trap 200 of FIG. 5, linear ion trap 200 of FIG. 5 replaces the linear ion trap 100 of FIG. 1*a* and Q3 of the mass spectrometer system of FIG. 1*b*.

Figure 6:
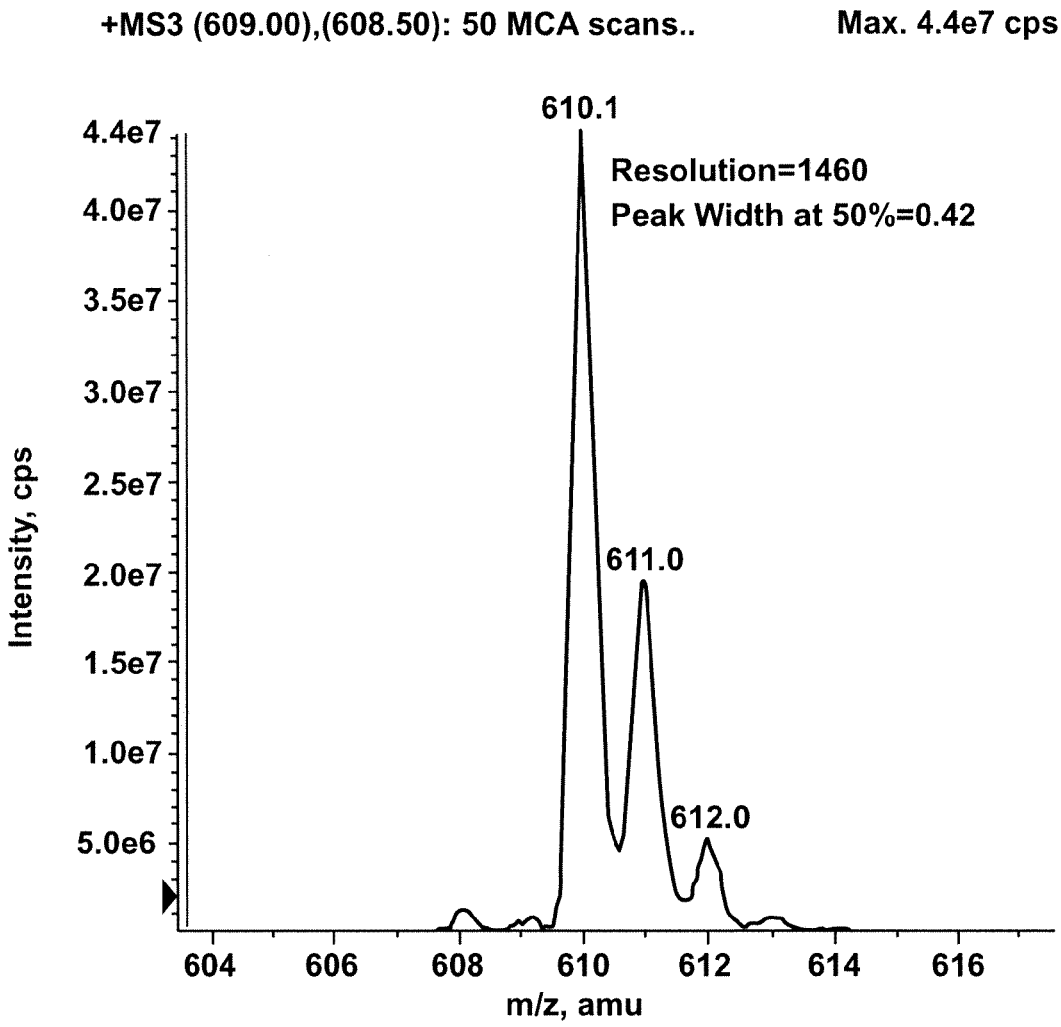
FIG. 6, in a graph, shows the performance of a mass selective axial ejection scan at 1000 Da/s obtained by applying the AC excitement voltage from the AC voltage source to two of the four auxiliary electrodes of the linear ion trap of FIG. 5.

Referring to FIG. 6, an ion trap spectra of the 609 Da/s reserpine ion obtained using the linear ion trap 200 of FIG. 5 at 1000 Da/s are shown.

Figure 7A:
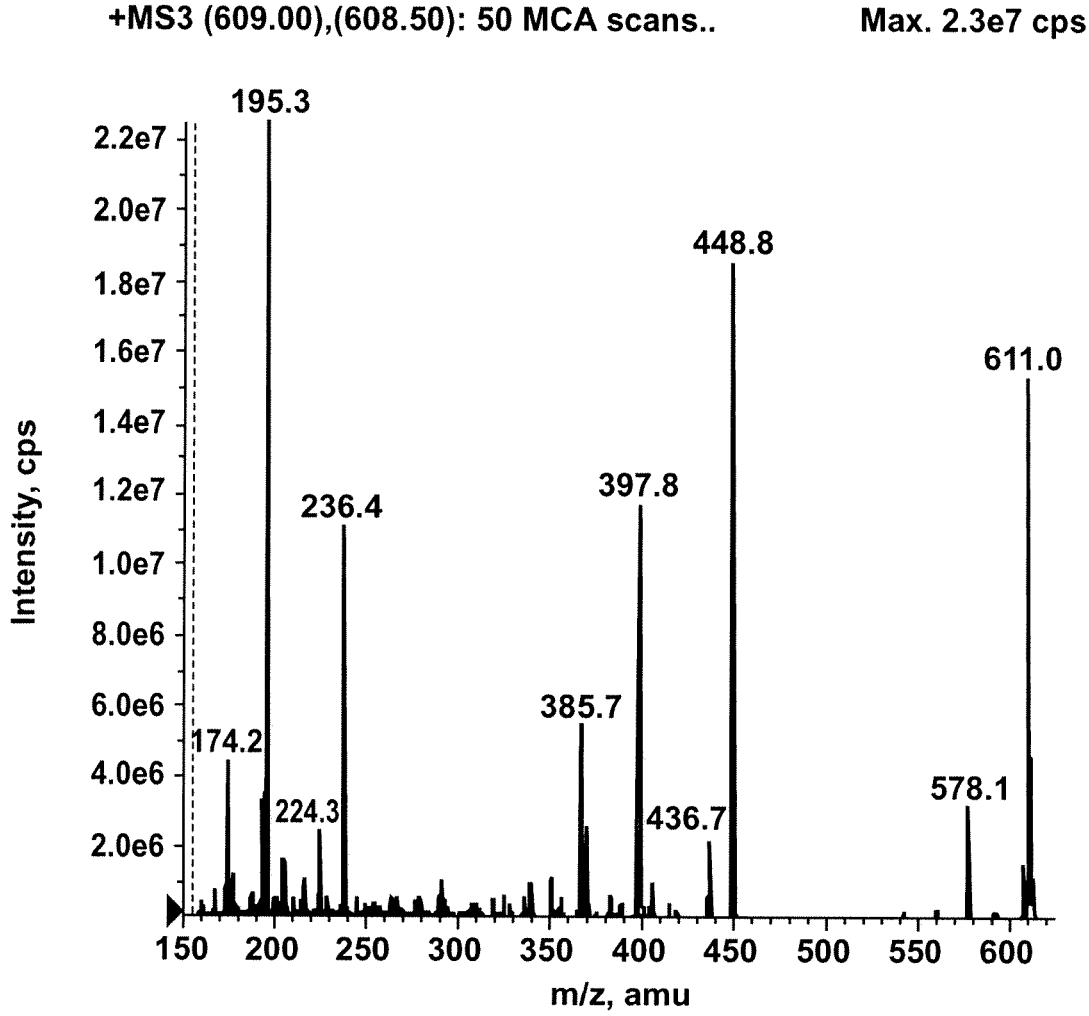
FIG. 7*a*, in a graph, shows the in-trap MS/MS spectra of the 609 Da/s reserpine ion obtained at 1000 Da/s after fragmentation in a linear ion trap of FIG. 5 using AC voltage excitation applied to two of the four auxiliary electrodes.
Figure 7B:
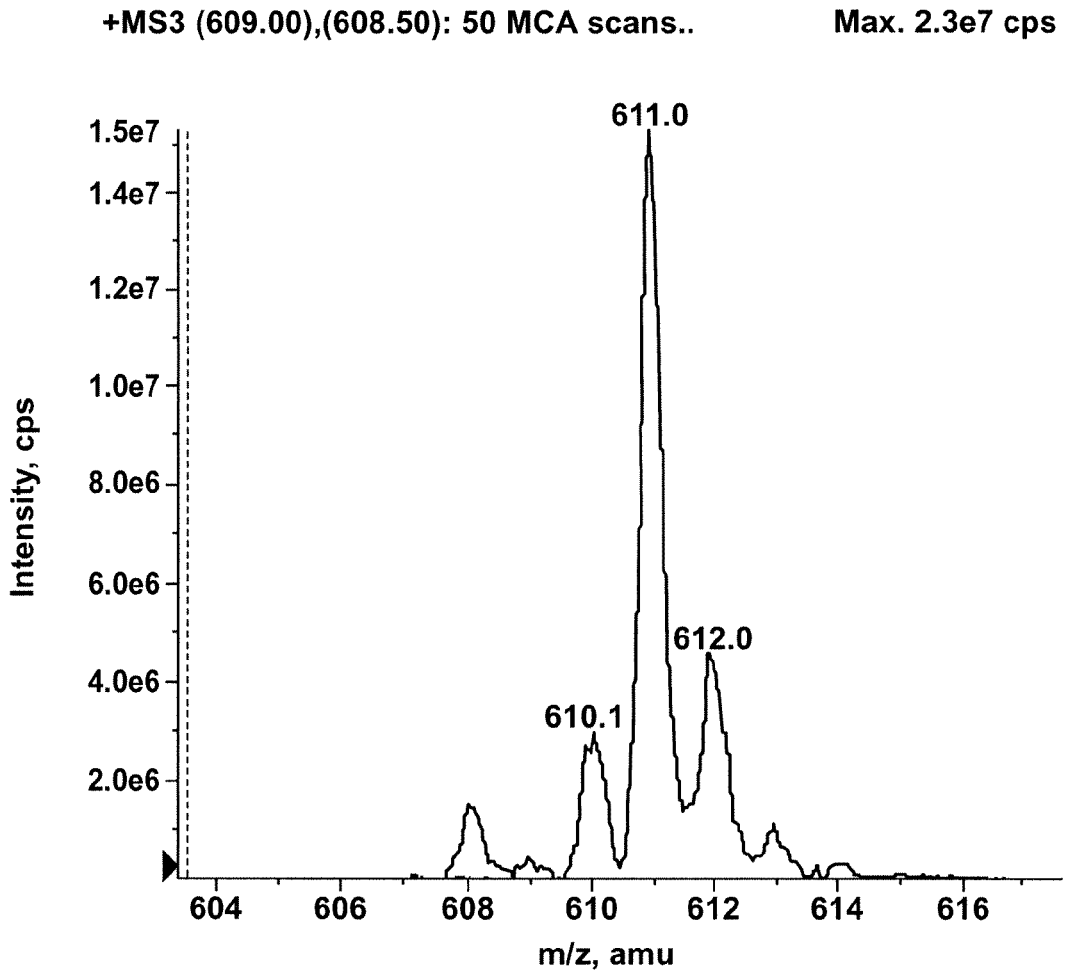
FIG. 7*b*, in a graph, illustrates the spectra of FIG. 7*a*, zoomed in around the parent ion.

Referring to FIG. 7*a*, an in-trap fragmentation spectra of the 609 Da/s reserpine ion obtained using the linear ion trap 200 of FIG. 5 operating at 1000 Da/s are shown. The excitation voltage applied to the auxiliary electrodes was 20Vp-p. If the depth of the stem is increased, i.e. closer to the axis, the field created by the T-electrodes becomes stronger. As a result the voltage required to be applied to electrodes for axial ejection to occur is lower. Referring to FIG. 7*b*, the spectra of FIG. 7*a* is again illustrated, zoomed around the parent ion.

Figure 8:
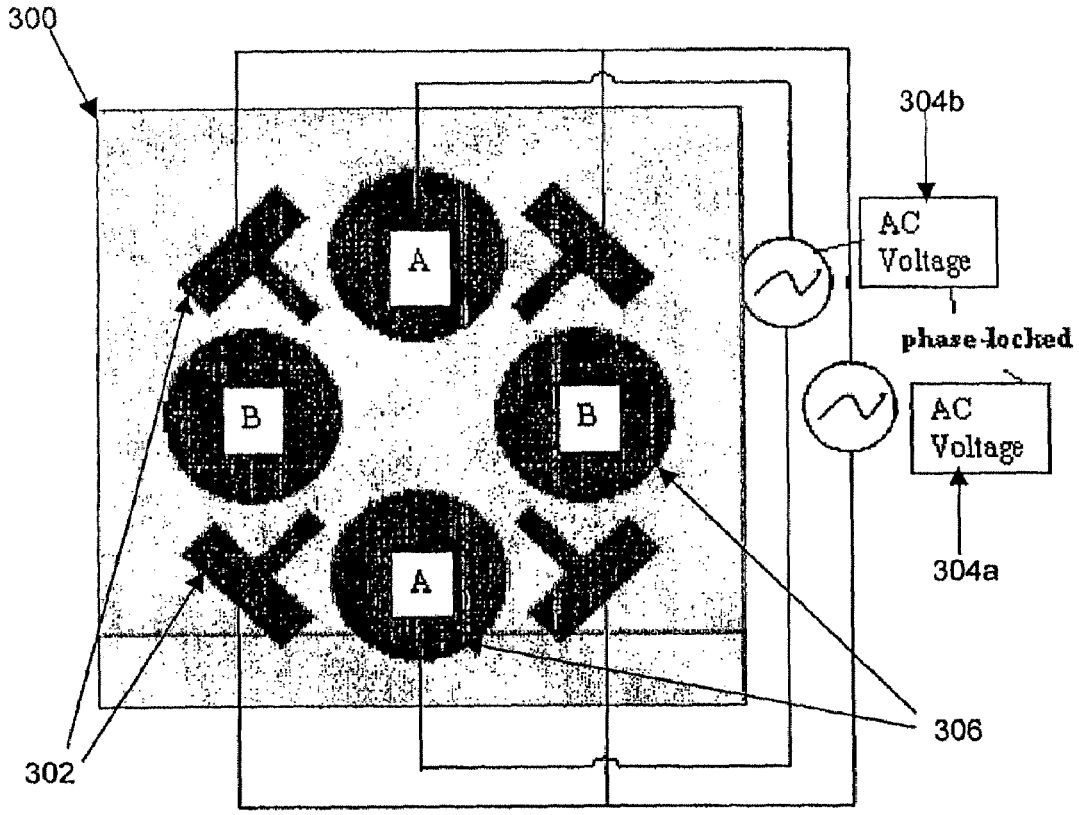
FIG. 8, in a sectional view, illustrates a yet further variant of a linear ion trap incorporating auxiliary electrodes using which methods in accordance with different aspects of an embodiment of the invention may be implemented.

Referring to FIG. 8, there is illustrated in a sectional view, a linear ion trap 300, which may be employed to implement a further method in accordance with a further aspect of a further embodiment of the present invention. For clarity, the same reference numerals with 200 added are used to designate elements of the linear ion trap 300 that are analogous to elements of the linear ion trap 100 of FIG. 1*a*. For brevity, at least some of the description of the linear ion trap 100 of FIG. 1*a* is not repeated with respect to linear ion trap 300 of FIG. 8.

Similar to linear ion trap 100 of FIG. 1*a*, the linear ion trap 300 of FIG. 8 comprises an AC voltage source 304*a* that is connected to all four auxiliary electrodes 302. However, in addition, the linear ion trap 300 of FIG. 8 also comprises a secondary AC voltage source 304*b* that is connected to the A-rods of the rod set 306 of the linear ion trap 300 to provide a dipolar auxiliary AC voltage to the A-rods. The AC voltage sources 304*a* and 304*b* are phase locked. Together, they can provide phase-locked AC excitement voltages to both the auxiliary electrodes and the A-rods to provide either mass selected axial ejection or in-trap fragmentation.

Figure 9:
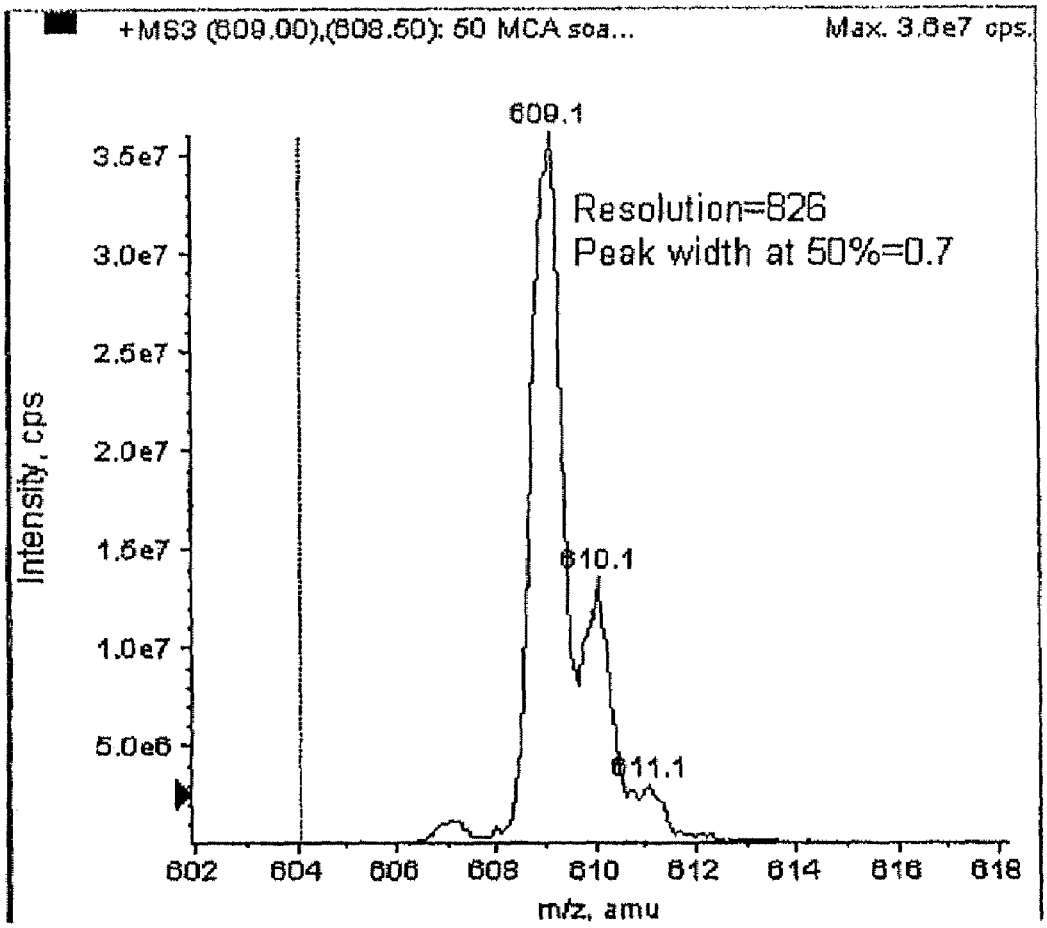
FIG. 9, in a graph, illustrates the ion trap spectra of the 609 Da/s reserpine ion obtained at 1000 Da/s, and axial scanned out of the linear ion trap of FIG. 8 using excitation on both the auxiliary electrodes and the A-rods of the rod set.

Referring to FIG. 9, an ion trap spectra of the 609 Da/s reserpine ion obtained at 1000 Da/s scan speed are shown. The ion is selected in the filtering quadupole Q1 at open resolution, transmitted through the Q2 collision cell at low collision energy (CE=10 eV) in the Q3 trap. Within the Q3 trap, the ion is DC/RF isolated and then cooled and scanned out of the trap using excitation voltages applied to the auxiliary electrodes and the A-rods.

Figure 10:
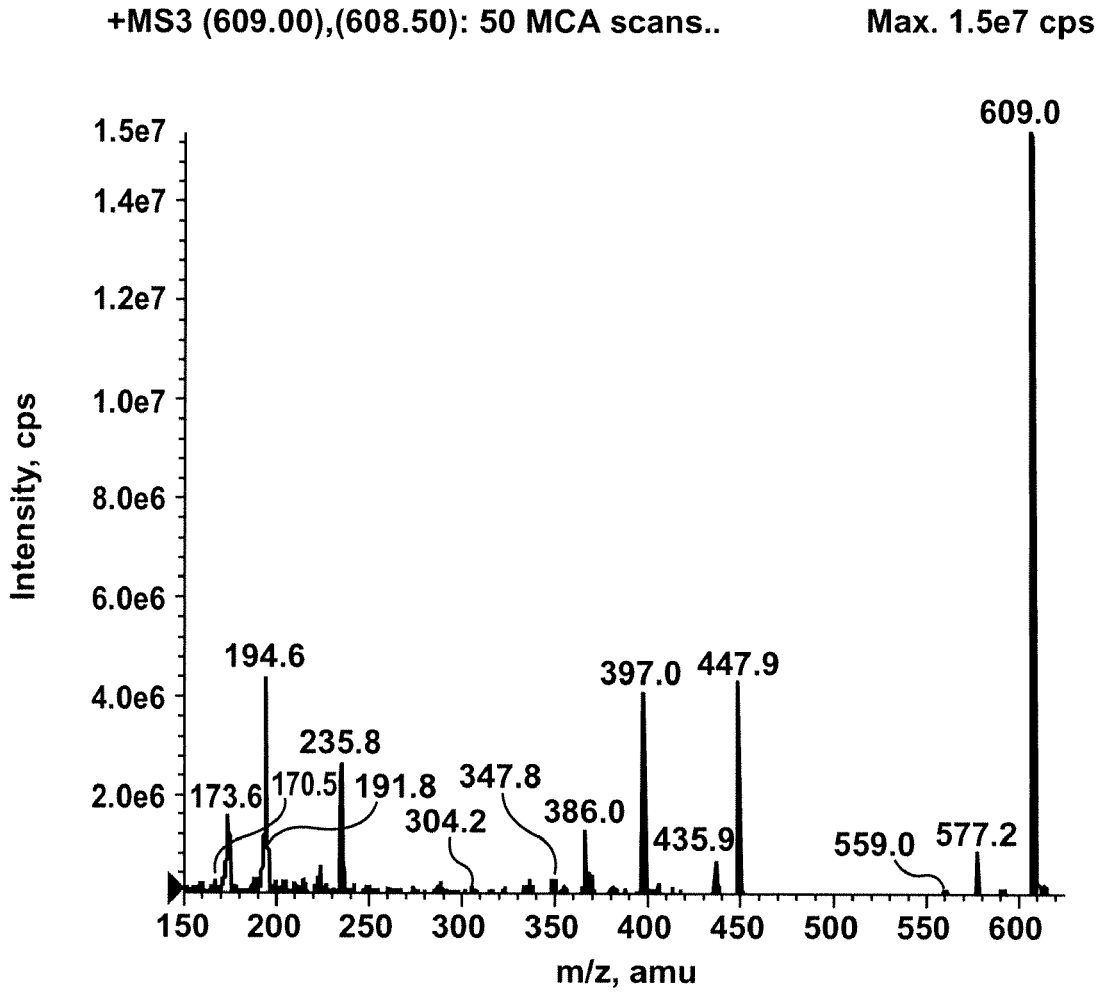
FIG. 10, in a graph, illustrates the in-trap fragmentation spectra of the 609 Da/s reserpine ion obtained at 1000 Da/s after fragmentation in a linear ion trap of FIG. 8 using AC voltage excitation applied to both the auxiliary electrodes and the A-rods of the rod set.

Referring to FIG. 10, an in-trap fragmentation spectra of the 609 Da/s reserpine ion is depicted. The excitation voltage applied to the auxiliary electrodes was 20Vp-p while the voltage applied to the main rods was 1Vp-p.

Figure 11A:
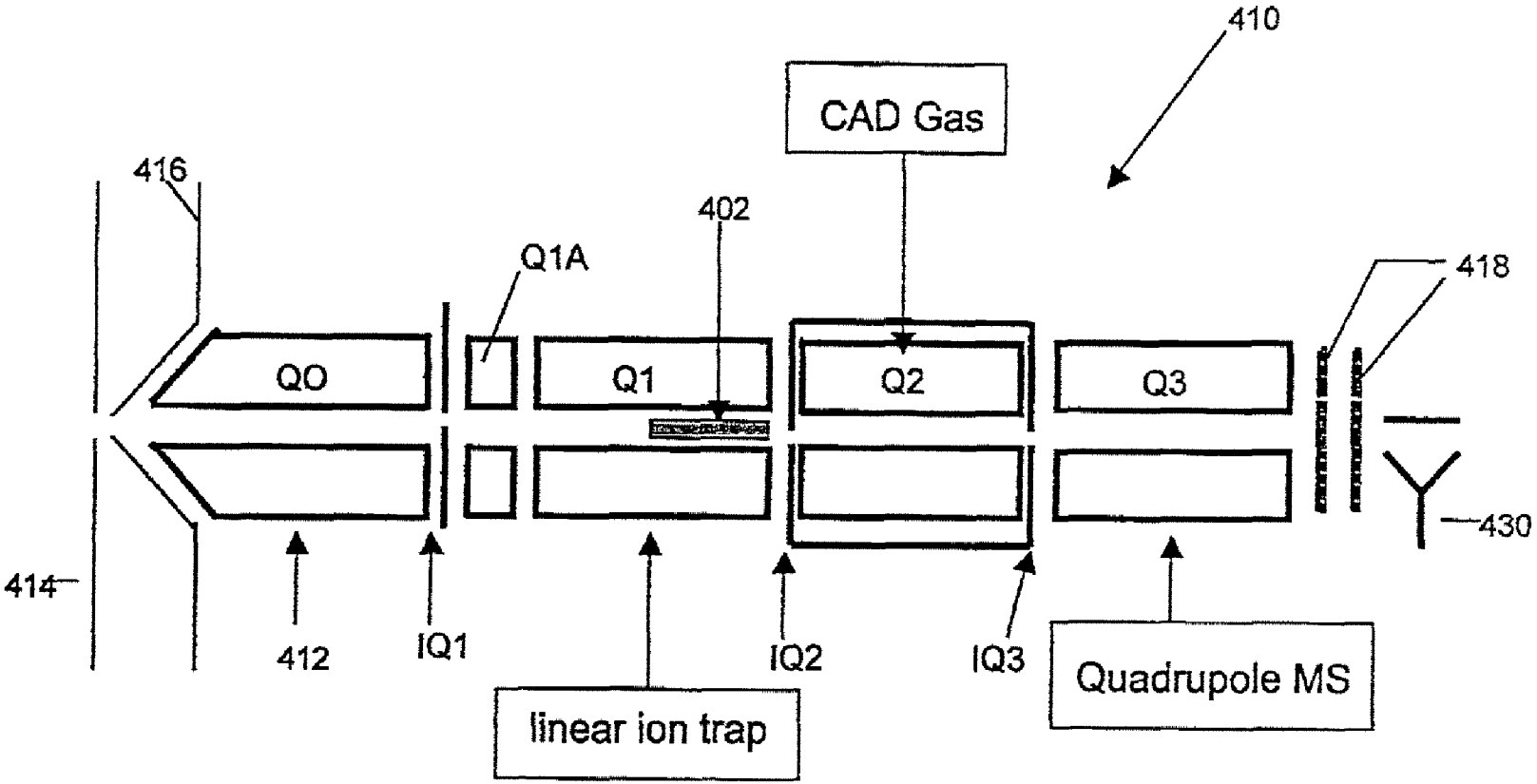
FIGS. 11*a*, 11*b* and 11*c*, in schematic diagrams, illustrate alternative variants of mass spectrometer systems incorporating linear ions traps having auxiliary electrodes that can be used to implement methods in accordance with different aspects of different embodiments of the present invention.
Figure 11B:
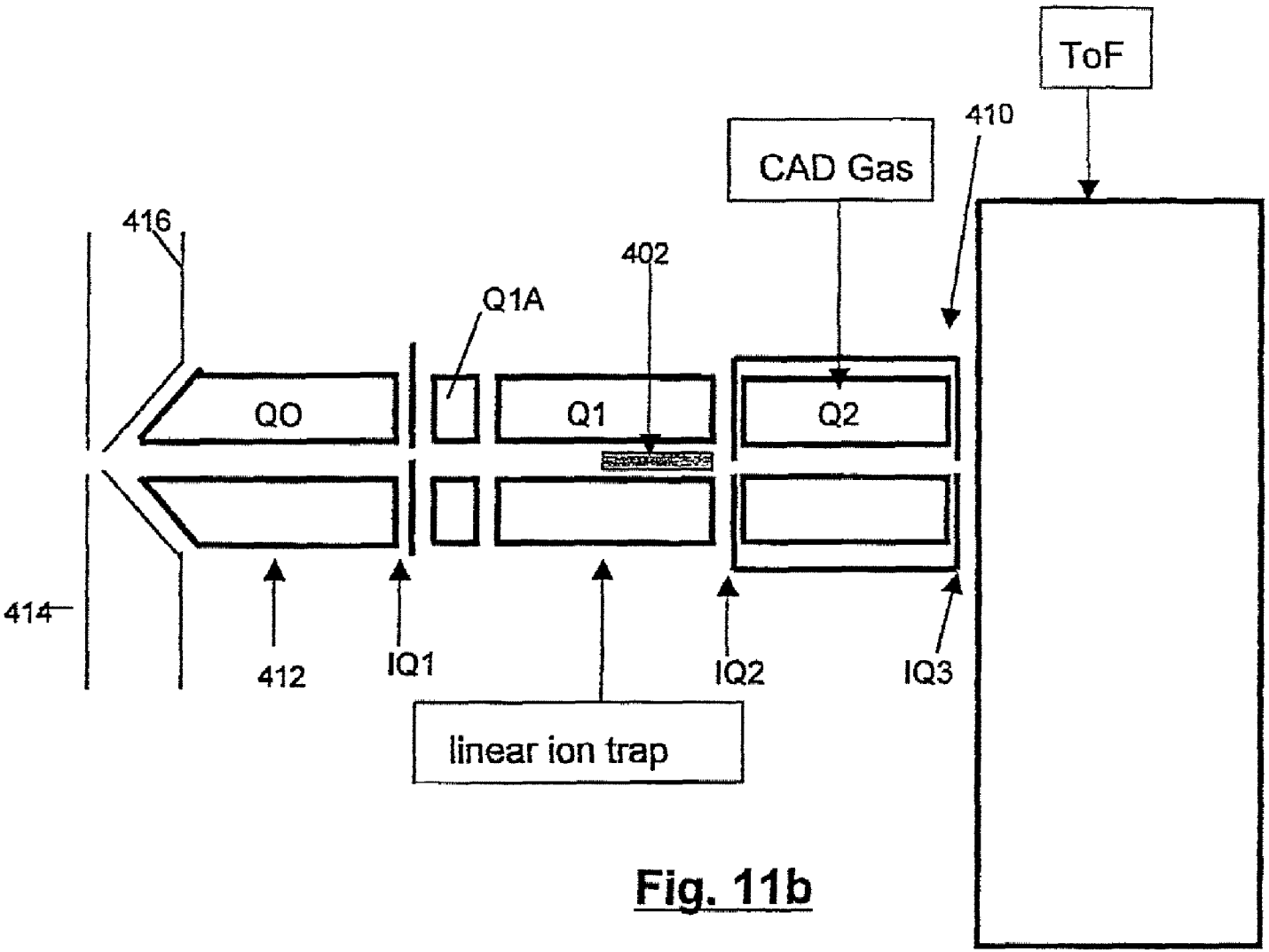
Figure 11C:
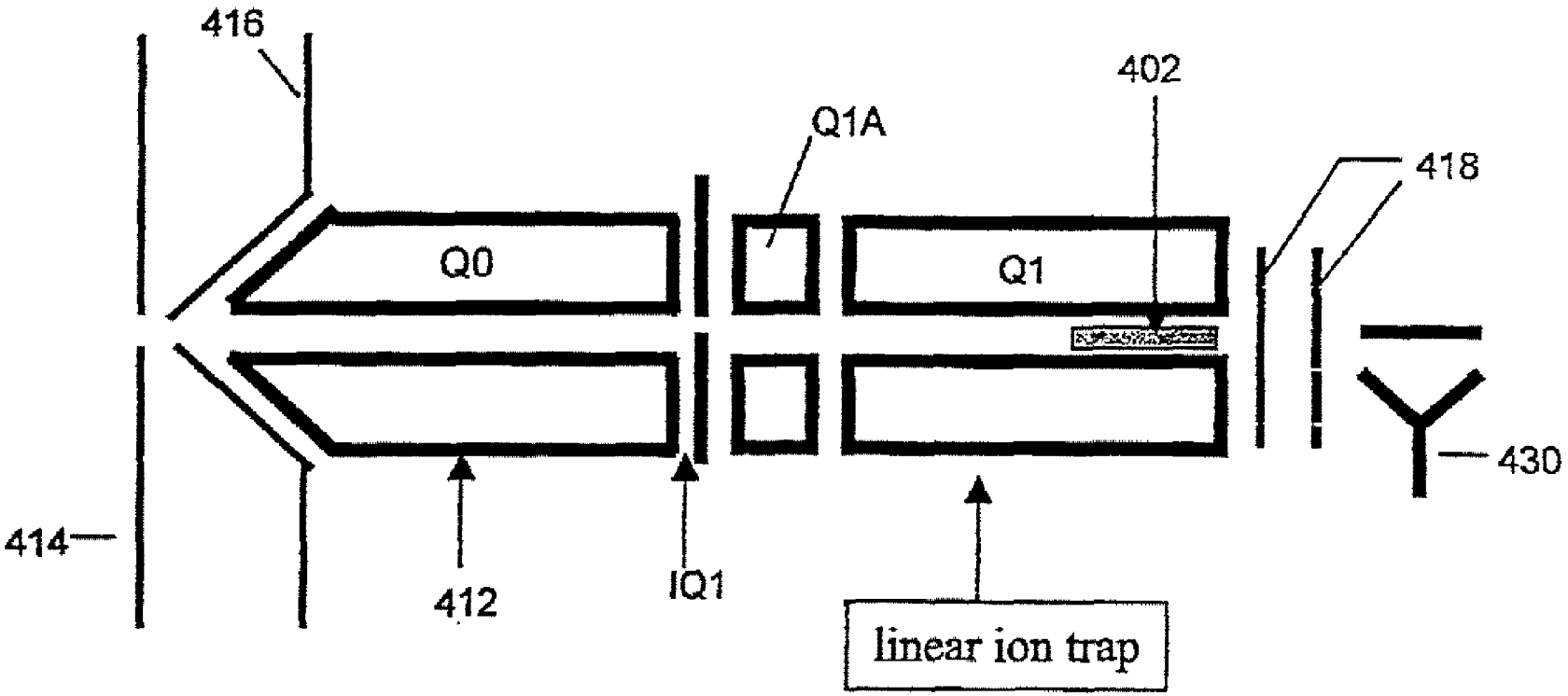

Referring to FIGS. 11*a*, 11*b* and 11*c*, there are illustrated in schematic diagrams alternative variants of linear ion trap mass spectrometer systems incorporating linear ion traps having auxiliary electrodes that may be used for either mass selective axial ejection or fragmentation as described above. For clarity, the same reference numerals are used for all of these different variants of linear ion trap mass spectrometer systems 400.

Referring specifically to the mass spectrometer system 410 of FIG. 11*a*, this configuration is very similar to the mass spectrometer system 100 of FIG. 1*b*, except that the positions of the linear ion trap and quadupole mass spectrometer have been changed. That is, in FIG. 11*a*, Q1 is a linear ion trap incorporating the auxiliary electrodes 402, while Q3 is the quadrupole mass spectrometer. Thus, using the mass spectrometer system 410 of FIG. 11*a*, ions may be mass selectively axially ejected from Q1 or fragmented in Q1 using auxiliary electrodes 402 in a manner analogous to that described above, before being transmitted to collision cell Q2 for subsequent fragmentation, and from thence to Q3 for further mass selection. For brevity, much of the description of the mass spectrometer system 110 of FIG. 1*b* is not repeated with respect to the mass spectrometer system 410 of FIGS. 11*a*, 11*b* and 11*c*. For clarity, the same reference numerals with 300 added are used to designate elements of the mass spectrometer systems 410 of any of FIGS. 11*a*, 11*b* and 11*c*, that are analogous to elements of the mass spectrometer system 110 of FIG. 1*b*.

Referring to FIG. 11*b*, a further variant of a linear ion trap mass spectrometer system 410 is illustrated. The linear ion trap mass spectrometer system of FIG. 11*b* is the same as that of FIG. 11*a*, except that in FIG. 11*b*, the quadrupole mass spectrometer Q3 is replaced with a time of flight (ToF) mass spectrometer. However, similar to the layout of FIG. 11*a*, the linear ion trap Q1 comprises the auxiliary electrode 402, to which excitation voltages can be applied for mass selective axial ejection or fragmentation of ions within Q1. These ions would subsequently be transmitted to collision cell Q2 for fragmentation, and from Q2 to the time of flight mass spectrometer for further mass selection.

Of course, as is shown by the layout of the mass spectrometer system of FIG. 11*c*, ions that are mass selectively axially ejected from Q1 can be detected without being subjected to further processing. That is, as shown in mass spectrometer system 410 of FIG. 11*c*, detector 430 is directly downstream from Q1. Thus, as described above, auxiliary AC voltages may be applied to the auxiliary electrodes 402 in Q1 of the mass spectrometer system 400 of FIG. 11*c* to fragment and mass selective axial eject ions from Q1 through the exit lenses 418 to the detector 430.

Figure 12A:
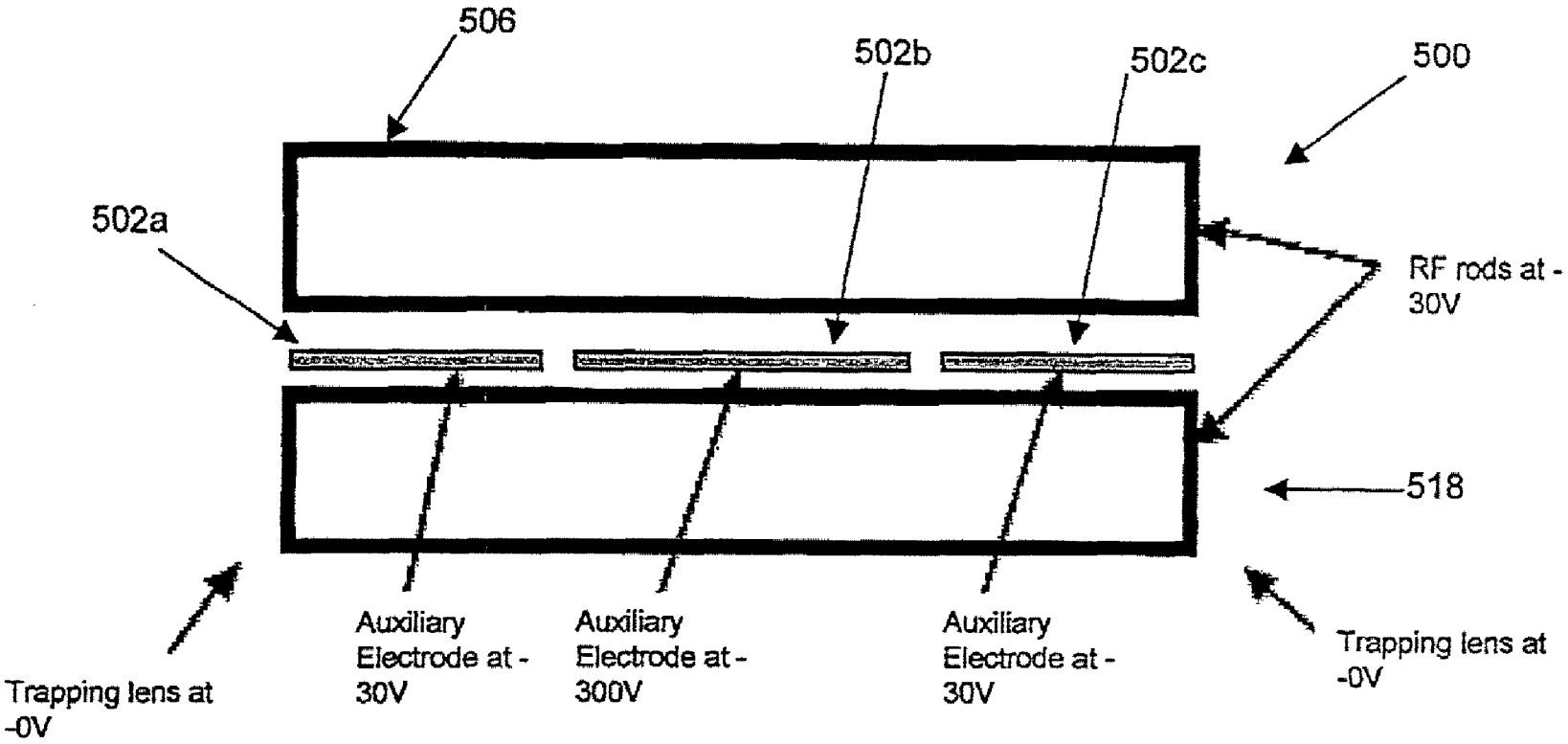
FIG. 12*a*, in a schematic diagram, illustrates a linear ion trap incorporating segmented auxiliary electrodes that can be used to implement yet further methods in accordance with yet further aspects of embodiments of the present invention.

Referring to FIG. 12*a*, there is illustrated in a schematic view, a linear ion trap 500 incorporating segmented auxiliary electrodes 502*a*, 502*b* and 502*c*, which may be employed to implement a further method in accordance with a further aspect of an embodiment of the present invention. As shown, the linear ion trap 500 also comprises a rod set 506. Further, the linear ion trap 500 comprises separate auxiliary AC voltage sources (not shown) for each of the auxiliary electrode segments 502*a*, 502*b* and 502*c*.

By applying different voltages to the different auxiliary electrode segments, these segmented auxiliary electrodes 502*a*, 502*b* and 502*c* can be used to spatially select and excite ions along a single linear multipole. This can be achieved, for example, according to the following method.

Figure 12B:
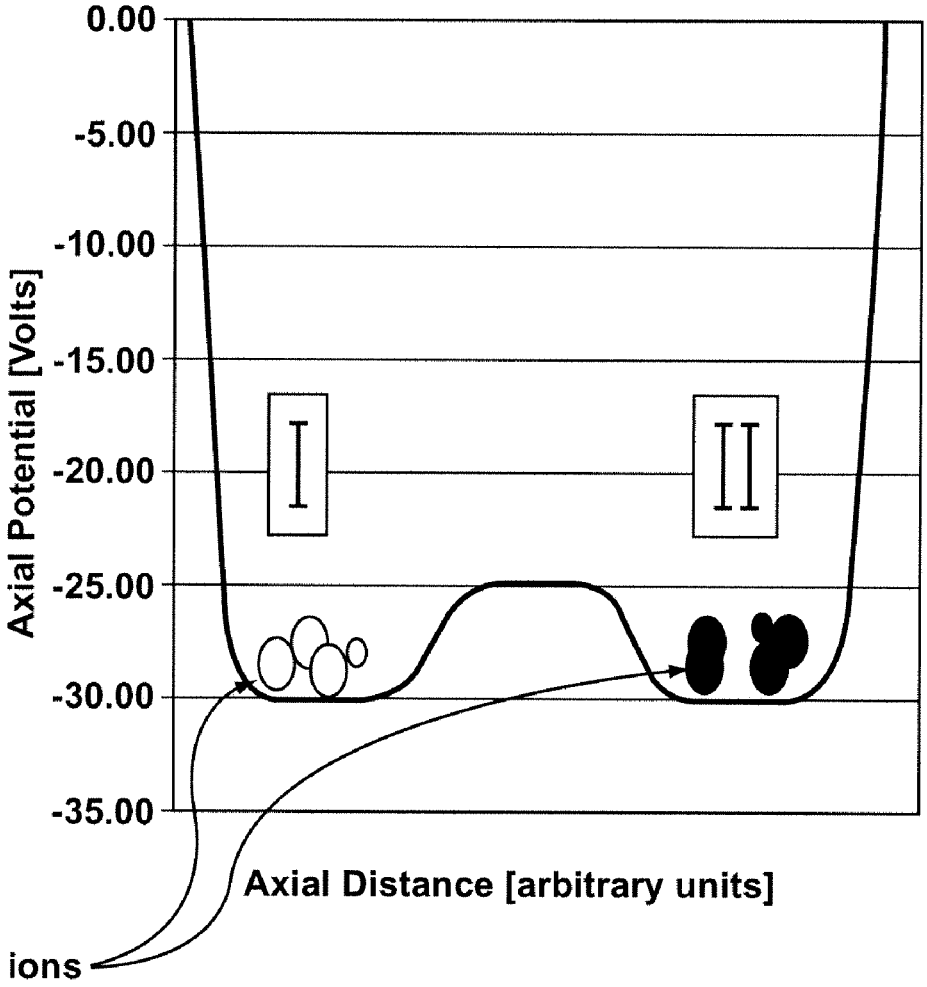
FIG. 12*b*, in a graph, illustrates voltage profiles and resulting ion separation that can be implemented using the segmented auxiliary electrodes of FIG. 12*a*.

The linear ion trap 500 can be filled with ions. At this point, the middle auxiliary electrode 502*b* can be maintained at the same voltage as the quadrupole rod offset. Once the linear ion trap 500 has been filled with ions, the voltage of the auxiliary electrode segment 502*b* can be raised to 300 volts. As shown in FIG. 12*b*, this will create potential wells I and II, each containing two different populations of ions separated by the voltage barrier provided by auxiliary electrode segment 502*b*.

Each of these ion populations in the potential wells I and II may contain ions of two or more different mass-to-charge ratios—for example $(m/z)_1$ and $(m/z)_2$. These ions would have different secular frequencies in the quadrupolar field. Accordingly, one can apply excitation voltages to the auxiliary electrodes with frequencies that match the frequency of each of these two different groups of ions. For example, in the first region—potential well I—one can fragment ions of mass-to-charge ratio $(m/z)_1$, while in the second region—potential well II—one can fragment ions of mass-to-charge ratio $(m/z)_2$. After this fragmentation step, one can apply an excitation voltage to auxiliary electrode segment 502*c* for mass selective axial ejection of selected ions from the second region—potential well II. Subsequently, the DC voltages on auxiliary electrode segments 502*b* and 502*c* can be dropped, while the DC voltage on auxiliary electrode segment 502*a* can be raised. As a result, the ion population formerly in potential well I can move into a new potential well skewed toward the exit trapping lens 518 of linear ion trap 500. Subsequently, this population of ions could be mass selective axial ejected from linear ion trap 500 by providing suitable excitation voltages to auxiliary electrode segments 502*c*. By this means, tandem MS and MS/MS in time and space can be implemented in a single multiple rod set.

Other variations and modifications of the invention are possible. For example, mass spectrometer systems other than those described above may be used. Further, with respect to aspects of the invention implemented using segmented electrodes, embodiments of linear ion traps including many more segmented electrodes could also be provided, to increase the number of MS/MS steps that can be implemented in a single mulitpole. All such modifications or variations are believed to be within the sphere and scope of the invention as defined by the claims appended hereto.

The invention claimed is:

1. A method of operating a mass spectrometer having an elongated rod set and a set of auxiliary electrodes, the rod set having an entrance end and an exit end and a longitudinal axis, the method comprising:

a) admitting ions into the entrance end of the rod set;

b) trapping at least some of the ions in the rod set by producing a barrier field at an exit member adjacent to the exit end of the rod set and by producing an RF field between the rods of the rod set, wherein the RF field and the barrier field interact in an extraction region adjacent the exit end of the rod set to produce a fringing field; and, c) providing an auxiliary ejection-inducing AC excitement voltage to the set of auxiliary electrodes to energize a first group of ions of a selected mass to charge ratio within the extraction region to mass selectively axially eject the first group of ions from the rod set past the barrier field;

wherein the set of auxiliary electrodes comprises a plurality of segments spaced lengthwise along the mass spectrometer, the plurality of segments comprising an entrance segment set of auxiliary electrodes, a middle segment set of auxiliary electrodes and an exit segment set of auxiliary electrodes;

the entrance segment set of auxiliary electrodes is between the middle segment set of auxiliary electrodes and the entrance end;

the exit segment set of auxiliary electrodes is between the middle segment set of auxiliary electrodes and the exit end;

step b) comprises trapping an entrance group of ions between the entrance segment set of auxiliary electrodes and an exit group of ions between the exit segment set of auxiliary electrodes, and providing a barrier voltage to the middle segment set of auxiliary electrodes to provide a barrier field between the entrance group of ions and the exit group of ions; and, step c) comprises i) providing the auxiliary ejection-inducing AC excitement voltage to the exit segment set of auxiliary electrodes to energize the ions of the selected mass to charge ratio within the extraction region to mass selectively axially eject the first group of ions from the rod set past the barrier field while retaining ions not of the selected mass to charge ratio.

2. The method as defined in claim 1 wherein step c) further comprises providing a secondary AC excitement voltage to the entrance segment set of auxiliary electrodes.

3. The method as defined in claim 2 wherein step a) comprises admitting a second group of ions in addition to the first group of ions, the second group of ions having a second selected mass to charge ratio different from the selected mass to charge ratio of the first ions;

each of the entrance group of ions and the exit group of ions comprises ions of the selected mass to charge ratio and ions of the second selected mass to charge ratio; and, the secondary AC excitement voltage is an auxiliary fragmentation excitement voltage selected to fragment the ions of the second selected mass to charge ratio in the entrance group of ions.

4. The method as defined in claim 3 wherein in step a) the first group of ions and the second group of ions are admitted together.

5. The method as defined in claim 2 wherein the secondary AC excitement voltage is an auxiliary fragmentation excitement voltage selected to fragment the ions of the selected mass to charge ratio in the entrance group of ions.

6. A method of operating a mass spectrometer having an elongated rod set and a set of auxiliary electrodes, the rod set having an entrance end and an exit end and a longitudinal axis, the method comprising:

a) admitting ions into the entrance end of the rod set;

b) trapping at least some of the ions in the rod set by producing a barrier field at an exit member adjacent to the exit end of the rod set and by producing an RF field between the rods of the rod set, wherein the RF field and the barrier field interact in an extraction region adjacent the exit end of the rod set to produce a fringing field; and c) fragmenting a parent group of ions located between the rods of the rod set by:

i) providing an auxiliary fragmentation AC excitement voltage to the set of auxiliary electrodes to energize the parent group of ions; and, ii) providing a background gas between the rods of the rod set.

7. The method as defined in claim 6 wherein step c) comprises providing the auxiliary fragmentation AC excitement voltage to the set of auxiliary electrodes to mass selectively radially excite the parent group of ions.

8. The method as defined in claim 7 wherein, in step b), the RF field and the barrier field interact in an extraction region adjacent the exit end of the rod set to produce a fringing field; and the method further comprises, after step c), providing an auxiliary ejection-inducing AC excitement voltage to the set of auxiliary electrodes to energize a first group of ions of a selected mass to charge ratio within the extraction region to mass selectively axially eject the first group of ions from the rod set past the barrier field.

9. The method as defined in claim 8 further comprising detecting at least some of the axially ejected first group of ions.

10. The method as defined in claim 8 further comprising axially ejecting the first group of ions to a downstream ion trap; and, processing the first group of ions in the downstream ion trap.

11. The method as defined in claim 8 further comprising axially ejecting the first group of ions to a downstream collision cell; and, fragmenting the first group of ions in the collision cell and then axially ejecting the first group of ions to a downstream mass spectrometer for mass analysis.

12. The method as defined in claim 6 wherein the set of auxiliary electrodes comprises at least four electrodes, and the auxiliary AC voltage is applied to all four electrodes.

13. The method as defined in claim 6 wherein the set of auxiliary electrodes comprises at least four electrodes, and the auxiliary AC voltage is applied to only two of the four electrodes.

* * * * *